US005839204A

United States Patent [19]

Cinque et al.

[11] Patent Number: 5,839,204

[45] Date of Patent: Nov. 24, 1998

[54] PORTABLE DRYER WITH A RETRACTABLE HANDLE PITTING INTO AN INDENTED HOUSING

[76] Inventors: Brenda A Cinque, 18 Guilford Park Dr., West Babylon, N.Y. 11704; Eugene Delaney, 65 Ontario Ave., Massapequa, N.Y. 11758

[21] Appl. No.: 910,306

[22] Filed: Aug. 13, 1997

[51] Int. Cl.[6] ..... A45D 24/10

[52] U.S. Cl. ..... 34/97; D28/16

[58] Field of Search ..... 34/283, 96, 97, 34/99; 132/144, 150; 392/380, 382, 384, 385; D28/10, 12, 16

[56] References Cited

U.S. PATENT DOCUMENTS

| | | | |
|---|---|---|---|
| 2,138,240 | 11/1938 | Kobusch | 34/7 |
| 3,383,700 | 5/1968 | Taylor | 34/99 |
| 3,846,047 | 11/1974 | Wada et al. | 34/97 X |
| 4,198,558 | 4/1980 | Benty | 34/97 X |
| 4,555,232 | 11/1985 | Raccah et al. | 432/222 |
| 4,636,613 | 1/1987 | De la Morandiere et al. | 34/97 X |
| 4,701,595 | 10/1987 | Okutsu et al. | 34/97 X |
| 4,757,183 | 7/1988 | Karey et al. | 219/365 |
| 4,972,065 | 11/1990 | Ohlsen | 392/380 |
| 5,341,578 | 8/1994 | Anderson | 34/97 |
| 5,394,620 | 3/1995 | Chimera | 34/97 |
| 5,467,540 | 11/1995 | Bastien | 34/97 |
| 5,608,975 | 3/1997 | Hsu | 34/97 |

*Primary Examiner*—Henry A. Bennett
*Assistant Examiner*—Steve Gravini
*Attorney, Agent, or Firm*—Andrew M. Calderon

[57] ABSTRACT

A portable dryer including a housing having an integrated fold up handle. At the outlet of the housing is an adjustable vent. The portable dryer is battery powered and may be used as cosmetic air dryer. A motor drives a variable speed fan which produces both cool and hot air.

12 Claims, 2 Drawing Sheets

PORTABLE DRYER WITH A RETRACTABLE HANDLE PITTING INTO AN INDENTED HOUSING

FIELD OF THE INVENTION

The invention relates generally to a portable dryer. In particular, the invention relates to a portable air blow dryer for drying make-up and other lotions after it is applied to the face and/or body.

BACKGROUND OF THE INVENTION

Many people apply cosmetics and body lotions to their faces and/or bodies for vanity and health reasons. Many of the cosmetics and lotions currently available are applied to a user's skin in a wet stage which allows a more even application and thus, a more natural appearance. Lotions are also applied in a wet stage for apparent reasons, such as for moisturizing a user's skin.

However, cosmetics and lotions tend to smear and smudge upon application. For example, eyeliner and mascara cause dark streaks under a user's eyes and, in many instances, stains a user's clothes. The latter scenario resulting from the user applying eyeliner or mascara, for example, prior to dressing.

Many inventors have developed drying devices. In particular these drying devices are directed towards drying a user's hair. These devices range from hood type devices to gas burning devices to portable cordless type dryers. These drying devices, however, do not appear to be very suitable for portable use because they cannot be folded into a compact size and shape. For example, U.S. Pat. No. 3,383,700 to W. D. Taylor discloses a portable hair dryer having a heating unit directly attached to the head.

Many other devices disclose cylindrical bodies having a pistol grip handle. These handles do not appear to be well suited for packing into small cases because the handles cannot be folded for compact packaging. For example, U.S. Pat. No. 4,555,232 to Raccah et al., U.S. Pat. No. 4,757,183 to Karey et al., U.S. Pat. No. 4,972,065 to Ohlsen and U.S. Pat. No. 5,394,620 to Chimera all discloses a dryer having a housing and a handle. Thus, none of these references disclose a portable dryer which is capable of folding up into a compact size and shape.

What is needed is a portable dryer that is small enough to fit into a pocket or other small carrying case. The portable dryer would have a collapsible handle portion that, when collapsed, would form an integral part of a housing portion.

SUMMARY OF THE INVENTION

It is therefore an object of the present invention to provide a portable dryer.

It is a further object of the present invention to provide a portable dryer having an integrated handle.

It is an additional object of the present invention to provide a portable air blower dryer.

It is still a further object of the present invention to provide a d.c. powered portable blow dryer for drying make-up and lotion after it is applied to a user's face and/or body.

These and other objects and advantages of the present invention will be apparent to those of ordinary skill in the art upon inspection of the detailed description, drawings, and appended claims.

The portable dryer comprises a housing having an integrated fold up handle. At the outlet of the housing may be an adjustable vent. In preferred embodiments, the portable dryer is battery powered and may be used as an eyelash and make-up air dryer. A motor drives a variable speed fan which produces both cool and hot air.

DETAILED DESCRIPTION OF THE PRESENT INVENTION

Figure 1:
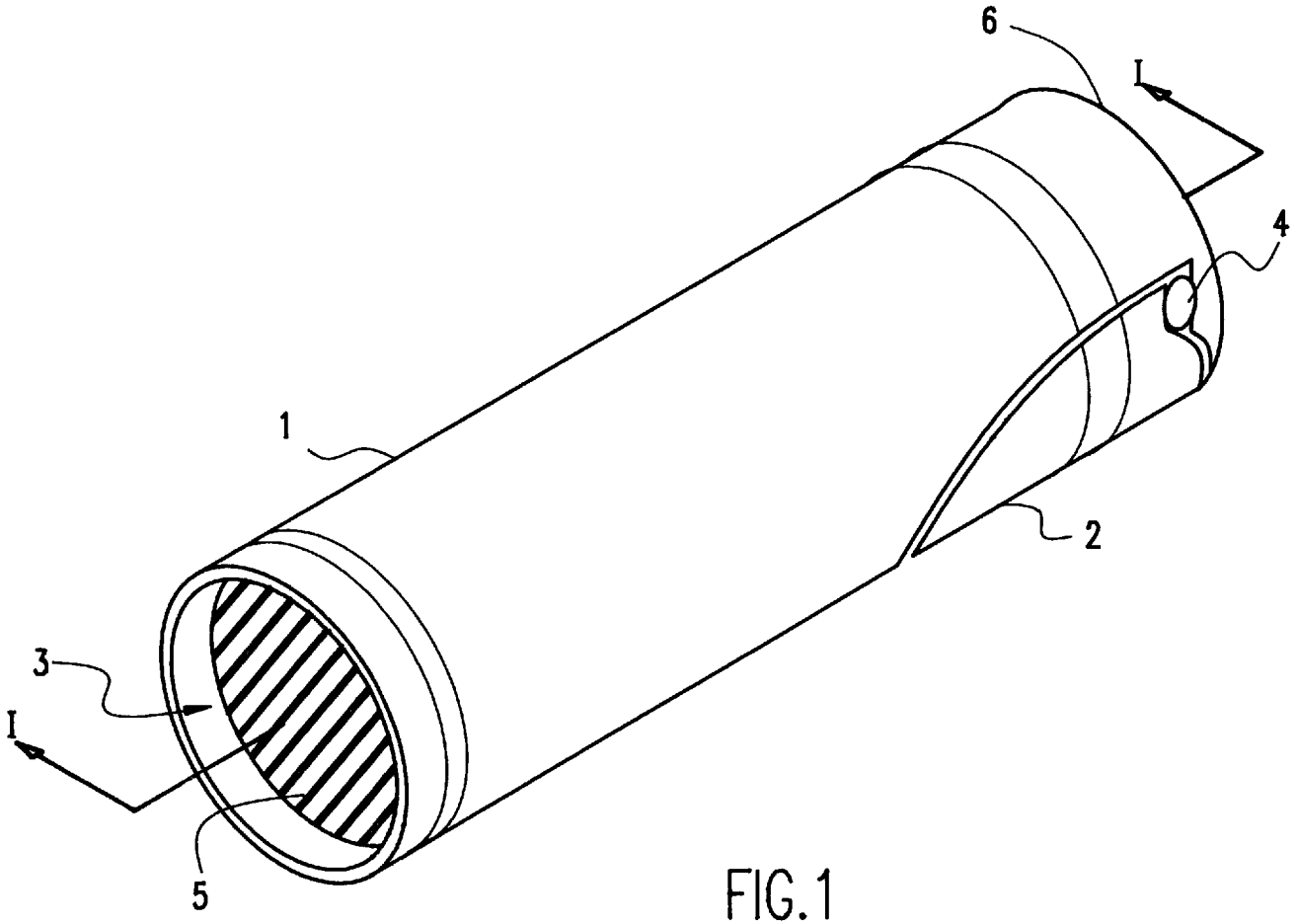
FIG. 1 shows a plan view of one embodiment of the present invention.

FIG. 1 shows a substantially hollow housing, generally depicted as 1. The hollow housing 1, for example, may be generally cylindrical and comprises an inlet opening 6 and an outlet opening 5 adjacent to the respective ends of the housing 1. The inlet opening 6 may, for example, have a protective inlet cover (not shown) in order to protect the user's hands. In preferred embodiments, the housing 1 defines a path for the airflow.

The housing 1 may also comprise other shapes, such as, for example, rectangular or square shapes. As discussed below, the housing 1 is provided with an indented portion so as to accommodate a handle 2 when it is in a folded position. Also, in alternate embodiments, the inlet opening 6 may be located at other areas on the housing 1.

Attached to the outlet opening 5 is a vent 3. In preferred embodiments, the vent 3 is adjustable and may, for example, be completely removed from the housing 1. The vent 3 directs airflow that is produced within the housing 1. In preferred embodiments, the vent 3 is rotatably mounted to the housing 1 so that the airflow may be directed in any direction. A plurality of other attachments, such as a diffuser, are also contemplated for use by the present invention.

As further seen in FIG. 1, a handle 2 is also provided. The handle 2 is pivotally mounted to the housing 1. The handle 2, for example, may be pivotally attached to the housing 1 by a hinge 4.

As seen clearly in FIG. 1, when the handle 2 is in a folded position it forms a part of the cross section of the housing 1. For illustrative purposes only, as seen in FIG. 1, the handle 2 forms part of the cylindrical cross section portion of the housing 1. In alternate embodiments, the handle 2 may form part of a rectangular or square housing, for example. Thus, when the handle 2 is in a folded position, the handle 2 and the housing 2, combined, form an integral cylindrical housing, for example. Accordingly, the indented portion of the housing accommodates the handle 2 when it is in a folded position.

Figure 2:
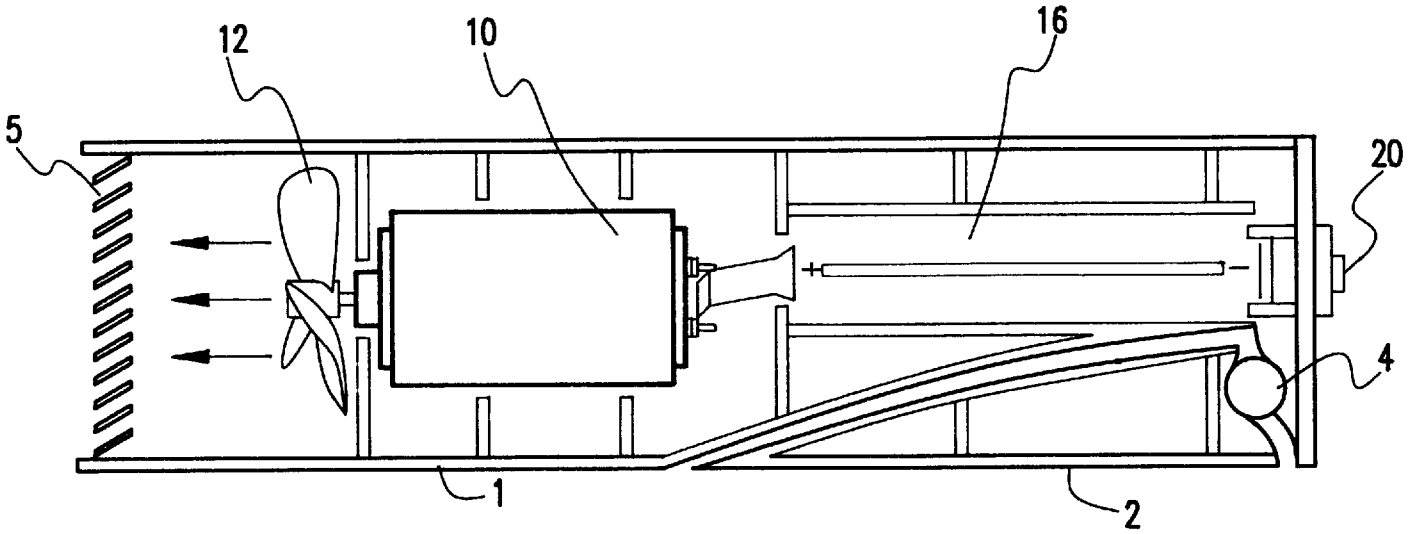
FIG. 2 shows a cut-away view of one embodiment of the present invention along line 1—1 of FIG. 1.

FIG. 2 shows a cut-away view of one embodiment of the present invention along line 1—1 of FIG. 1. More particularly, FIG. 2 shows an interior portion of the housing 1. Located within the housing 1 is a motor 10, preferably a d.c. powered motor. The motor 10 has variable temperature settings and adjustable heating means (not shown) which are well known in the art such that hot and/or cool air may be produced. A fan 12 is attached to the motor 10. Also located in the housing 10 may be a battery compartment 16 which accommodates a battery for powering the heating motor 10. Attached to one end of the housing 1 is the vent 5. Attached to the other end of the housing 1 is preferably a battery cover 18 having an on/off switch 20.

When the handle 2 is folded into the housing 1 the entire unit forms a compact portable dryer. When the handle 2 is folded away from the housing 1 it provides a handle for the user.

Preferred and alternative embodiments of the portable dryer have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons of ordinary skill in the art.

What is claimed is:

1. A portable dryer having an air inlet and an air outlet, the portable dryer further having a motor and fan that is driven by the motor, the portable dryer further having a power source to power the motor, the portable dryer further comprising:

a housing having at least a first portion proximate to the air inlet and a second portion proximate to the air outlet, the first portion having a first cross sectional area having an indented portion, the second portion having a second cross sectional area different from the first cross sectional; and a fold up handle pivotally mounted to the housing, wherein the indented portion receives the handle when the handle is in a folded position, the folded handle forming a portion of the housing so that the first cross sectional area substantially equals the second cross sectional area.

2. The apparatus of claim 1, wherein when the handle is in an open position it forms a handle, and wherein when the handle is in an open position the second cross sectional area is substantially different than the first cross sectional area.

3. The apparatus of claim 1, further comprising an air vent positioned at the air outlet.

4. The apparatus of claim 1, wherein the portable dryer is battery powered.

5. The apparatus of claim 1, wherein the air inlet is covered with a protective covering.

6. The apparatus of claim 1, wherein the second portion of the housing is cylindrical, and wherein the first portion of the housing includes an upper section and a lower section, the upper section having a substantially semi-cylindrical cross section and the lower section including the indented portion for when the handle is in a closed position, the handle, in the closed position, and the lower section, combined, forming a semi-cylindrical cross section, wherein the upper section and the lower section, when the handle is in the closed position, forms a cylindrical cross section so that the first cross sectional area substantially equals the second cross sectional area.

7. The apparatus of claim 1, further comprising an on/off switch associated with the heating motor.

8. A portable dryer having an air inlet and an air outlet, the portable dryer further comprising:

a substantially cylindrical housing having at least a first portion proximate to an air inlet and a second portion proximate to an air outlet, the first portion having a first cross sectional area having an indented portion, the second portion having a substantial cylindrical cross sectional area, the substantial cylindrical cross sectional area being different from the first cross sectional; and a fold up handle pivotally mounted to the housing, wherein the indented portion receives the handle when the handle is in a folded position, the folded handle forming a portion of the housing so that the first cross sectional area forms a substantial cylindrical cross sectional area substantially equaling the second cross sectional area.

9. The apparatus of claim 8, wherein when the handle is in an open position it forms a handle, and wherein when the handle is in an open position the second cross sectional area is substantially different than the first cross sectional area.

10. The apparatus of claim 8, further comprising an air vent positioned at the air outlet.

11. The apparatus of claim 8, wherein the air inlet is covered with a protective covering for covering a battery.

12. The apparatus of claim 8, wherein the first portion of the housing includes an upper section and a lower section, the upper section having a substantially semi-cylindrical cross section and the lower section including the indented portion for accommodating the handle when the handle is in a closed position, the handle, in the closed position, and the lower section, combined, forming a semi-cylindrical cross section, wherein the upper section and a lower section, when the handle is in the closed position, forms a cylindrical cross section so that the first cross sectional area substantially equals the second cross sectional area.

* * * * *